United States Patent [19]

Plester et al.

[11] 4,227,833

[45] Oct. 14, 1980

[54] MINERAL MINING INSTALLATION

[75] Inventors: Karl-Heinz Plester, Lunen; Friedrich Eggenstein, Bergkamen-Oberaden, both of Fed. Rep. of Germany

[73] Assignee: Gewerkschaft Eisenhutte Westfalia, Lunen, Fed. Rep. of Germany

[21] Appl. No.: 1,652

[22] Filed: Jan. 8, 1979

[30] Foreign Application Priority Data

Jan. 7, 1978 [DE] Fed. Rep. of Germany ..... 2800619

[51] Int. Cl.[2] ..... E21D 23/00

[52] U.S. Cl. ..... 405/299; 405/291

[58] Field of Search ..... 405/291, 292, 295–301; 91/170 MP; 299/31–33

[56] References Cited

U.S. PATENT DOCUMENTS

| | | | |
|---|---|---|---|
| 3,949,562 | 4/1976 | Blumenthal et al. | 405/296 |
| 4,028,898 | 6/1977 | Blumenthal et al. | 405/299 |
| 4,045,089 | 8/1977 | Hauschopp et al. | 405/291 X |
| 4,073,151 | 2/1978 | Harsma | 405/301 X |

*Primary Examiner*—David H. Corbin

*Attorney, Agent, or Firm*—Sughrue, Rothwell, Mion, Zinn and Macpeak

[57] ABSTRACT

A mineral mining installation comprises a longwall structure, such as a conveyor or a winning installation, and a roof support assembly constituted by a plurality of roof support units positioned side-by-side. At least some of the roof support units are provided with hydraulic bracing rams for bracing the longwall structure longitudinally. Each bracing ram is pivotally connected between the longwall structure and the floor sill of a respective roof support unit. Each ram is connected to its floor sill by connection means constituted by a bracket slidably mounted on that floor sill for movement towards, and away from, the longwall structure. Means are provided for securing each of the brackets to its floor sill in any one of a plurality of positions.

12 Claims, 5 Drawing Figures

MINERAL MINING INSTALLATION

BACKGROUND OF THE INVENTION

The invention relates to a mineral mining installation having a longwall structure, such as a conveyor or winning installation, and a roof support assembly constituted by a plurality of side-by-side roof support units at least some of which are provided with hydraulic bracing rams for bracing the longwall structure longitudinally.

In known installations of this type, each bracing ram is pivotally mounted between the longwall structure and the floor sill of one of the roof support units, the rams being inclined at small acute angles to the longitudinal axis of the longwall structure. The floor sills are provided with brackets for the connection of the bracing rams.

During mining operations, it may be necessary to alter the distance between one or more of the roof support units and the longwall structure, for example to enable the roof shield or shields to be advanced as closely as possible to the face being won. This is particularly important where the face slopes. Any such change in the position of a roof unit inevitably results in a change of the angle of inclination of the associated bracing ram. This in turn results in a variation of the bracing forces applied to the longwall structure which is undesirable. In particular, the bracing force decreases as the inclination of the rams increases with an increase in the distance between the longwall structure and the roof support units. This disadvantage can be overcome by adapting the points at which the bracing rams are attached to that floor sill to the changing operating conditions. The known way of accomplishing this is to change the connecting brackets.

The object of the invention is to provide connection means for such bracing rams which enable their brackets to be positioned rapidly and easily whilst ensuring that the rams maintain their required inclination even when the associated roof support units are moved.

SUMMARY OF THE INVENTION

In its broadest aspect, the invention provides, in a mineral mining installation constitued by a longwall structure and a roof support unit, the roof support unit being provided with a hydraulic bracing ram acting on said structure to brace said structure longitudinally, the bracing ram being pivotally attached to the floor sill of the roof support unit by connection means, the improvement comprising constituting the connection means by a bracket which is slidably mounted on the floor sill adjacent to said structure, for movement towards, and away from, said structure, means being provided for securing the bracket to the floor sill in any one of a plurality of positions.

Advantageously, a guide plate is provided at said end of the floor sill, the bracket being slidable along the guide plate.

Thus, the bracket which forms an abutment for the bracing ram can be arranged in a space-saving manner at the front (face-side) end of the floor sill. Moreover, the bracket can extend from the floor sill to varying degrees so that it is possible to maintain the bracing ram at the required inclination even when the associated roof support unit is moved. The advance movement of such a unit is not impeded by the bracket, and the bracket is readily accessible so that it can be adjusted rapidly and easily.

Conveniently, the bracket comprises a base plate, which is slidable on said guide plate and a pair of upstanding, parallel guide flanges fixed to the upper surface of the base plate. The entire bracket is expediently of welded construction. Advantageously, the floor sill is provided at said one end thereof, with a pair of mutually facing guide strips positioned above the guide plate, the base plate of the bracket being a sliding fit between the guide plate and the guide strips, and the guide flanges of the bracket slidingly engaging guide surfaces formed on the floor sill.

That end of the bracket adjacent to said structure may be provided with a head-piece which is pivotally attached to the hydraulic bracing ram by means of a connector. Advantageously, the connector is removably fastened to the head-piece within either one of a pair of spaced holes formed in the head-piece. This enables the same bracket to be engaged by two bracing rams inclined respectively towards opposite ends of the longwall structure. It also enables the same bracket to be used whichever way the associated ram is to be inclined, one of the holes in the head-piece being used for a ram inclined to one end of the structure and the other hole being used for a ram inclined towards the other end of the structure.

Said securing means may be constituted by a pin which engages in aligned holes in the bracket and the floor sill. Preferably, a plurality of holes are provided in each of said guide flanges, said holes being spaced apart in the direction of movement of the bracket, and wherein aligned holes are provided one in each of said guide surfaces, a pin being insertable through said holes in said guide surfaces and through an aligned pair of holes in said guide flanges thereby constituting said securing means. Alternatively, an elongate slot is provided in the base-plate of the bracket, the slot extending in the direction of movement of the bracket, and an upstanding pin is fixed to the upper surface of the guide plate, the pin passing through the slot and being provided with releasable locking means for clamping the base plate to the guide plate, the pin slot and locking means constituting said securing means.

Advantageously, the end of the base plate remote from said structure is formed with a cut-out.

The adjustment of the bracket can be carried out manually though it is preferable for this to be effected by means of a ram.

The invention also provides a longwall mineral mining installation comprising a conveyor extending along the longwall face and a roof support assembly positioned on the goaf side of the conveyor, the roof support assembly being constituted by a plurality of roof support units positioned side-by-side, at least some of the roof support units being provided with hydraulic bracing rams each of which acts between the floor sill of one of said at least some of the roof support units and the conveyor thereby to brace the conveyor longitudinally, wherein each hydraulic bracing ram is pivotally attached to the floor sill of its associated roof support unit by connection means constituted by a bracket which is slidably mounted on the end of the said floor sill adjacent to the conveyor, for movement towards, and away from, the conveyor, and wherein means are provided for securing each bracket to the corresponding floor sill in any one of a plurality of positions.

Advantageously, each of the roof support units is provided with an advance mechanism for advancing that unit towards the conveyor, the advance mechanism incorporating a guide rod system whose conveyor side end is connected to a head-piece attached to the conveyor, the guide rod system of each of said at least some of the roof support units being adjustably connected to the conveyor to adapt the guide rod system to the position of the bracket of that unit.

BRIEF DESCRIPTION OF THE DRAWINGS

Preferred embodiments of the invention will now be described, by way of example, with reference to the accompanying drawings, in which.

DESCRIPTION OF PREFERRED EMBODIMENTS

Figure 1:
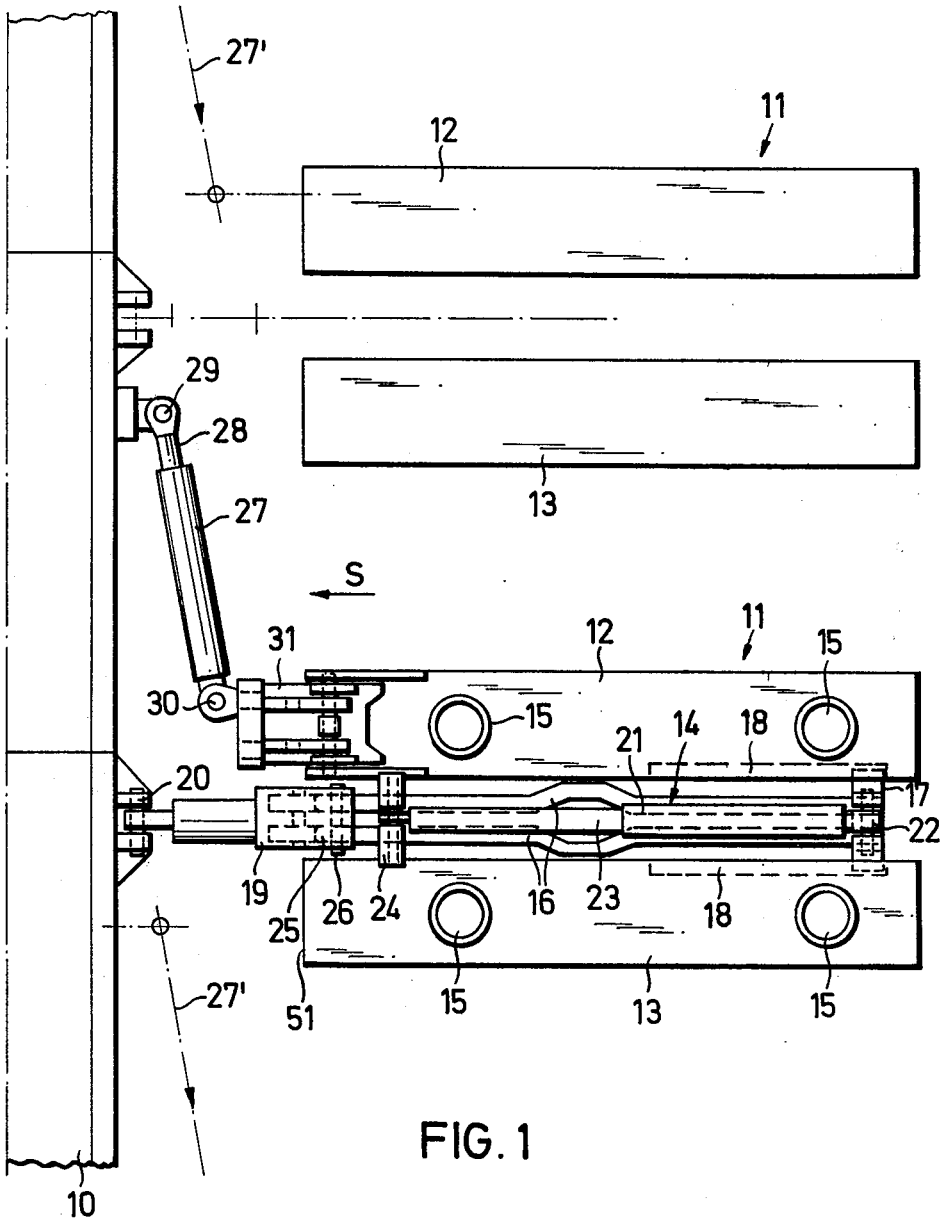
FIG. 1 is a diagrammatic plan view of a part of a mineral mining installation incorporating hydraulic bracing ram connection means constructed in accordance with the invention.
Figure 2:
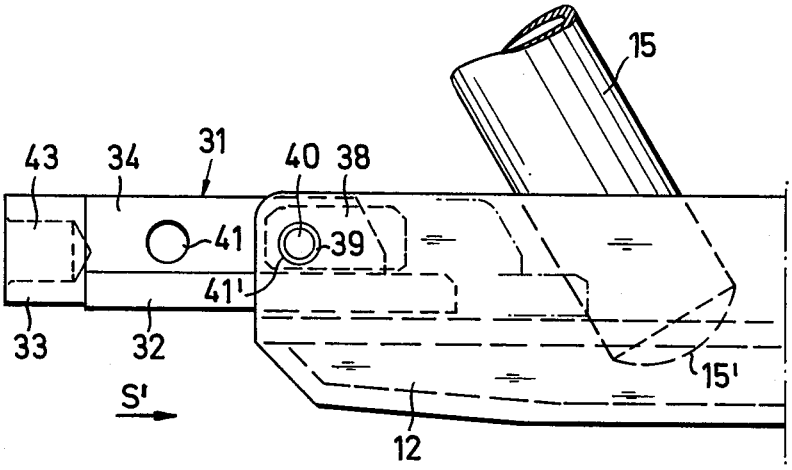
FIG. 2 is a side elevation, on an enlarged scale, of the connection means of FIG. 1.

Referring to the drawings, FIG. 1 shows part of a long-wall mineral mining installation having a scraper-chain conveyor 10 provided with a guide (not shown) for a coal-winning machine (not shown) such as a plough or a shearer. A mine roof support assembly, constituted by a plurality of roof support units 11 positioned side-by-side, is provided at the goaf side of the conveyor 10. The roof support units 11 can be advanced, either singly, or in groups, by means of advance mechanisms 14 to follow up the advance of the face and the conveyor 10. Each of the roof support units 11 (only two of which can be seen in FIG. 1) has a floor sill constituted by a pair of laterally spaced floor girders 12 and 13, the advance mechanism 14 being positioned between these floor girders. The floor girders 12 and 13 of each unit 11 support a roof shield (not shown) by means of hydraulic props 15. Each of the props 15 is supported on the corresponding floor girder 12 or 13 by means of a respective articulated foot joint 15′ (one of which is shown in FIG. 2). The roof shields of the units 11 may be of one-piece or multi-piece construction.

The advance mechanism 14 of each unit 11 has a pair of resilient, generally parallel, guide rods 16. The rear (goaf-side) ends of the guide rods 16 are connected by means of a cross-piece 17 which is slidable, in the opposing side faces of the floor girders 12 and 13 of that unit 11. The cross-piece 17 is also pivotable in a plane perpendicular to that of the longwall face. The front (face-side) ends of the guide rods 16 are interconnected by means of a head-piece 19 which, in turn, is pivotally connected to the conveyor 10 by means of a pivot joint 20. A double-acting hydraulic advance ram 21 completes the advance mechanism 14, the cylinder of the ram being connected to the cross-piece 17 by means of a pivot joint 22, and the piston rod 23 of the ram being pivotally connected to a yoke 24 which is fixed to the floor girders 12 and 13 in their front (face-side) regions. The advance mechanism 14 is such that, on retraction of the ram 21, the conveyor 10 is thrust towards the face; and, on extension of the ram, the roof support unit 11 advances in a follow-up sequence.

The two guide rods 16 are adjustably mounted in the head-piece 19 so that the distance between the face-side edges 51 of the floor girders 12 and 13 and the conveyor 10 can be adjusted. This adjustable mounting is effected by providing drilled holes 25 in the head-piece 19, into which the face-side ends of the guide rods 16 slidingly fit. In order to fix the guide rods 16 to the head-piece 19, in any one of a plurality of adjusted positions, a pin 26 is inserted into aligned holes (not shown) drilled laterally in the head-piece and the guide rods. The head-piece has a plurality of these lateral holes spaced apart in the direction S of advance, so that the guide rods 16 can be fixed thereto in any one of a plurality of positions.

In order to brace the conveyor 10 in its longitudinal direction, hydraulic bracing rams 27 are provided, each of which is fitted between a respective roof support unit 11 and the conveyor 10. FIG. 1 shows only one of these bracing rams 27, the direction of bracing of the two adjacent rams being indicated by the dash-dot arrows 27′. Each bracing ram 27 takes up both tensile and compressive forces. The piston rod 28 of each ram 27 is pivotally connected to the conveyor 10 by means of a pivot joint 29 having a vertical pivot axis. Similarly, the cylinder of each ram 27 is pivotally connected to the floor girder 12 of its roof support unit 11 by means of a pivot joint 30 which also has a vertical pivot axis. The pivot joint 30 is provided on a bracket 31 arranged at the face-side edges 51 of the floor girder 12.

As can be seen from FIG. 1, each of the bracing rams 27 is inclined at an acute angle to the longitudinal axis of the conveyor 10. In order that the force components of the rams 27 that act in the longitudinal direction of the conveyor 10 (that is to say the forces actually doing the bracing) shall be as large as possible, each of the rams is inclined to the longitudinal axis of the conveyor by as small an angle as is practical. However, the angle of inclination between a ram 27 and the longitudinal axis of the conveyor 10 increases as the distance between the face-side edges 51 of the associated roof support unit 11 and the conveyor increases. In order to ensure that the rams 27 maintain their desired angles of inclination, irrespective of the positions of their roof support units 11, the brackets 31 are displaceable relative to the floor girders 12 in the direction S of advance.

Figure 3:
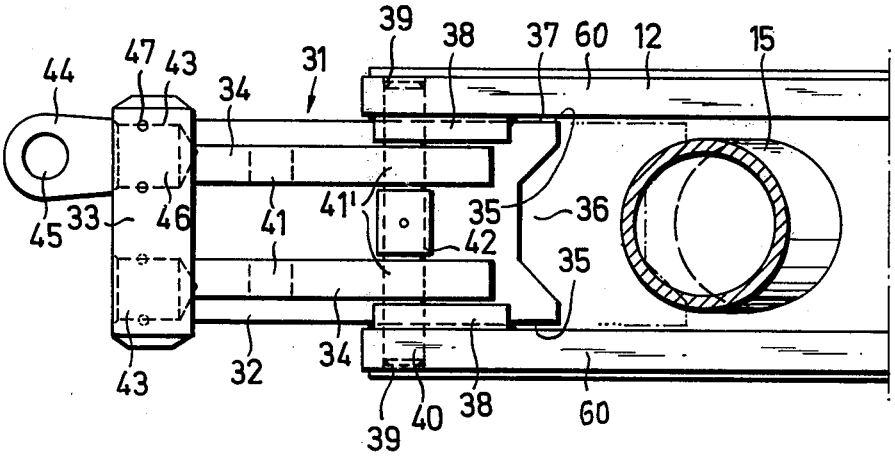
FIG. 3 is a plan view of the connection means shown in FIG. 2.

Referring to FIGS. 2 and 3, each bracket 31 has a relatively wide, horizontal base plate 32 to which is welded a head-piece 33. Two guide flanges 34 are welded to the upper surface of the base plate 32, the guide flanges projecting upwardly from the base plate and being parallel. The guide flanges 34 extend from the head-piece 33 to points close to the rear (goaf-side) end of the base plate 32. In this region, the base plate 32 is provided with a cut-out 36.

The front (face-side) end of the floor girder 12 is provided with a guide plate 37 along which the bracket 31 can slide in a manner analogous to that of a sliding drawer. The floor girder has two upstanding flanges 60, one on either side of the guide plate 37. Each of the flanges 60 is provided with an inwardly-directed guide strip 38 under which the base plate 32 of the bracket 31 engages thus preventing the bracket from falling out of its engagement with the guide plate 37. The lateral edges 35 of the base plate slidingly engage the flanges 60 to guide the bracket 31 accurately for movement in the direction S of advance, and in the direction S' of retraction.

Lateral holes 39 are drilled through the flanges 60 of the floor girder 12, these holes also extending through the guide strips 38. A pair of longitudinally-spaced holes 41 and 41' are provided in each of the flanges 34 of the bracket 31. A pin 40 is insertable through the holes 39 and 41 or through the holes 39 and 41' to lock the bracket 31 to the floor girder 12 in one of two positions. A sleeve 42 is secured to the upper surface of the base plate 32, the axis of the sleeve being aligned with the axes of the holes 39. FIGS. 2 and 3 show the pin 40 in engagement with the holes 39 and 41', that is to say with the bracket 31 in its extended position. FIGS. 2 and 3 also show, in dash-dot lines, the retracted position of the bracket 31, that is to say the position it assumes when the pin 40 passes through the holes 39 and 41. In this retracted position, the cut-out 36 engages the adjacent prop 15 of the floor girder 12. Where the bracket 31 is required to be locked to the floor girder 12 in any one of more than two positions, three or more longitudinally-spaced holes, such as 41, 41' may be provided in each of the flanges 34.

Two holes 43 are drilled in the face-side end of the head-piece 33. The holes 43 are provided to accommodate a connector 44 having an eye 45 and a plug body 46, the plug body being fitted into either of the holes 43 as required, and held securely but releasably in there by means of a clamping sleeve 47 or by pins (not shown). The eye 45 forms part of the pivot joint 30 connecting the bracing ram 27 to the floor girder 12.

Figure 4:
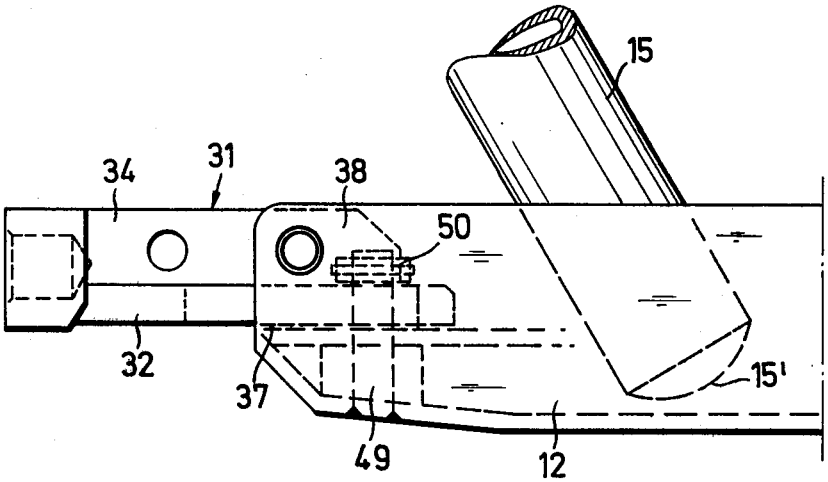
FIG. 4 is a side elevation, on an enlarged scale, of a modified form of connection means.
Figure 5:
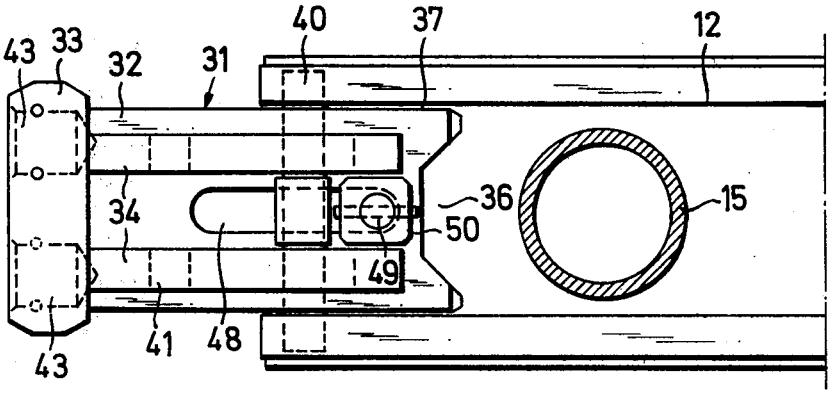
FIG. 5 is a plan view of the connection means of FIG. 4.

The connection means shown in FIGS. 4 and 5 is very similar to that of FIGS. 2 and 3. Accordingly, like reference numerals have been used for like parts, and only the parts of the embodiment of FIGS. 4 and 5 which differ from FIGS. 2 and 3 will be described. The base plate 32 of the bracket 31 of FIGS. 4 and 5 has a longitudinally-extending slot 48, through which extends a vertical plug 49 welded to the guide plate 37 of the floor girder 12. The upper end of the plug 49 is provided with a detachable locking member 50 which is operative to clamp the base plate 32 to the guide plate 37 in any one of an infinite number of positions delimited by the slot 48. The plug and slot connection 48/49 limits the extent of the displacement of the bracket 31 relative to the floor girder 12, and also constitutes a guide for the bracket. Moreover, this connection prevents the bracket 31 from falling out of engagement with the guide plate 37, so there is no need for the guide strips 38 of the embodiment of FIGS. 2 and 3.

We claim:

1. In a mineral mining installation including a longwall structure and a roof support unit, the roof support unit being provided with a substantially horizontal, hydraulic bracing ram disposed at an acute angle to the longwall structure and acting on said structure to brace said structure longitudinally, the bracing ram being pivotally attached to a floor sill of the roof support unit by connection means, the improvement characterized by:

the connection means comprising a bracket slidably mounted on an end of the floor sill adjacent to said longwall structure for movement towards and away from said structure, and means for securing the bracket to the floor sill in any one of a plurality of positions to enable the angular position of the bracing ram to be maintained substantially constant when the distance between the roof support unit and the longwall structure is changed.

2. Connection means according to claim 1, further comprising a guide plate provided at said end of the floor sill, the bracket being slidable along the guide plate.

3. Connection means according to claim 2, wherein the bracket comprises a base plate, which is slidable on said guide plate, and a pair of upstanding, parallel guide flanges fixed to the upper surface of the base plate.

4. Connection means according to claim 3, wherein the floor sill is provided, at said one end thereof, with a pair of mutually facing guide strips positioned above the guide plate, the base plate of the bracket being a sliding fit between the guide plate and the guide strips, and the guide flanges of the bracket slidingly engaging guide surfaces formed on the floor sill.

5. Connection means according to claim 3, wherein that end of the bracket adjacent to said structure is provided with a head-piece which is pivotally attached to the hydraulic bracing ram by means of a connector.

6. Connection means according to claim 5, wherein the connector is removably fastened to the head-piece within either one of a pair of spaced holes formed in the head-piece.

7. Connection means according to claim 1, wherein said securing means is constituted by a pin which engages in aligned holes in the bracket and the floor sill.

8. Connection means according to claim 4, wherein a plurality of aligned first holes are provided opposite each other in each of said guide flanges, said holes being spaced apart in the direction of movement of the bracket, and wherein aligned second holes are provided one in each of said guide surfaces, a pin being insertable through said second holes in said guide surfaces and through aligned first holes in said guide flanges thereby constituting said securing means.

9. Connection means according to claim 3, wherein an elongate slot is provided in the base plate of the bracket, the slot extending in the direction of movement of the bracket, and an upstanding pin is fixed to the upper surface of the guide plate, the pin passing through the slot and being provided with releasable locking means for clamping the base plate to the guide plate, the pin slot, and locking means constituting said securing means.

10. Connection means according to claim 3, wherein the end of the base plate remote from said structure is formed with a cut-out.

11. A longwall mineral mining installation comprising a conveyor extending along the longwall face and a roof support assembly positioned on the goaf side of the conveyor, the roof support assembly comprising a plurality of roof support units positioned side-by-side, at least some of the roof support units being provided with substantially horizontal, hydraulic bracing rams disposed at an acute angle to the conveyor and each of which acts between a floor sill of one of said at least some of the roof support units and the conveyor thereby to brace the conveyor longitudinally, wherein each hydraulic bracing ram is pivotally attached to the floor sill of its associated roof support unit by connection means comprising a bracket slidably mounted on the end of said floor sill adjacent to the conveyor for movement towards and away from the conveyor, and wherein means are provided for securing each bracket to its associated floor sill in any one of a plurality of positions to enable the angular position of each bracing ram to be maintained substantially constant when the distance between the roof support units and the conveyor is changed.

12. An installation according to claim 11, wherein each of the roof support units is provided with an advance mechanism for advancing that unit towards the conveyor, the advance mechanism incorporating a guide rod system whose conveyor side end is connected to a head-piece attached to the conveyor, the guide rod system of each of said at least some of the roof support units being adjustably connected to the conveyor to adapt the guide rod system to the position of the bracket of that unit.

* * * * *